US005086198A

United States Patent [19]

Arakawa

[11] Patent Number: 5,086,198

[45] Date of Patent: Feb. 4, 1992

[54] ELECTRIC SWITCH

[75] Inventor: Motoi Arakawa, Shimane, Japan

[73] Assignee: Omron Tateisi Electronics Co., Kyoto, Japan

[21] Appl. No.: 555,790

[22] Filed: Jul. 23, 1990

Related U.S. Application Data

[63] Continuation of Ser. No. 293,453, Jan. 4, 1989, abandoned.

[30] Foreign Application Priority Data

Jan. 6, 1988 [JP] Japan ..... 63-517
Jan. 6, 1988 [JP] Japan ..... 63-518

[51] Int. Cl.[5] ..... H01H 5/18

[52] U.S. Cl. ..... 200/456; 200/445; 200/408

[58] Field of Search ..... 200/445, 447, 448, 456, 200/454, 458, 408, 409

[56] References Cited

U.S. PATENT DOCUMENTS

| | | | |
|---|---|---|---|
| 2,521,277 | 9/1950 | Aubert | 200/456 |
| 2,740,857 | 4/1956 | Porland | 200/456 |
| 2,892,050 | 6/1959 | Fisher | 200/456 |
| 2,927,171 | 3/1960 | Rhodes | 200/456 |
| 3,322,915 | 5/1967 | Johnson | 200/456 |
| 4,843,200 | 6/1989 | Parlatore et al. | 200/339 |

FOREIGN PATENT DOCUMENTS

| | | | |
|---|---|---|---|
| 2052610 | 5/1972 | Fed. Rep. of Germany | 200/447 |

*Primary Examiner*—Henry J. Recla
*Assistant Examiner*—Glenn T. Barrett
*Attorney, Agent, or Firm*—Fish & Richardson

[57] ABSTRACT

An electric switch comprising a fixed contact attached to a casing, a moveable contact piece carrying a moveable contact, an elastic piece which is actuated by an external force between two positions which are located on either side of the moveable contact piece along the common direction of motion of the moveable contact piece and the elastic piece, and a U-shaped spring member engaged between the free ends of the moveable contact piece and the elastic piece. As the elastic piece is moved past the moveable contact piece, the spring action of the U-shaped spring member upon the moveable contact piece changes its direction in such a manner that the moveable contact is positively pressed upon the fixed contact or displaced away from the latter without producing any indeterminate state of contact between the moveable and fixed contacts. Since the U-shaped spring is engaged with the free ends of the moveable contact piece and the elastic piece with the moveable contact piece located therebetween, the distance between the two legs of the U-shaped spring member may be maximized for a given space, and the strains in the U-shaped spring is thereby minimized. Additionally, by providing stoppers for the elastic piece to limit its deformation, it is avoided that the U-shaped spring member be deformed more than necessary.

6 Claims, 2 Drawing Sheets

ELECTRIC SWITCH

This application is a continuation of U.S. application Ser. No. 07/293,453 filed Jan. 4, 1989 now abandoned.

TECHNICAL FIELD

The present invention relates to an electric switch which comprises a moveable contact piece carrying a moveable contact, a fixed contact, an actuator member, typically adapted to be operated upon manually, for moving the moveable contact into contact with and away from the fixed contact, and a spring member which urges the moveable contact into contact with and away from the fixed contact depending on the state of the actuator member.

BACKGROUND OF THE INVENTION

The moveable contacts carried by moveable contact pieces of electric switches are required to move quickly into contact with and away from the fixed contacts because an indeterminate state of contact between a fixed contact and a moveable contact often causes undesirable generation of heat particularly when an inductive load is involved. To produce such a desired quick motion of moveable contact pieces, electric switches are often provided with snap springs which change the directions of their action upon moveable contact pieces in a desired manner depending on the state of the manual actuator.

Since an electric switch using a snap spring involves a toggle action, a considerable force is required to be produced by the snap spring and considerable strain is produced in the snap spring. Therefore, ensuring the durability of the snap spring is a major task in designing a small electric switch using a snap spring.

BRIEF SUMMARY OF THE INVENTION

In view of such a problem of the prior art, a primary object of the present invention is to provide an electric switch using a snap spring which is highly compact and durable at the same time.

A second object of the present invention is to provide an electric switch which gives a favorable feel to the user.

According to the present invention, these and other objects of the present invention can be accomplished by providing an electric switch, comprising: a casing; an actuating member which is guided for motion between a first position and a second position relative to said casing; a fixed contact fixedly attached to said casing; a moveable contact piece carrying a moveable contact and supported by said casing at its base end in the manner of a cantilever, said moveable contact piece being capable of bending or pivoting motion about said base end thereof between a first position to contact said moveable contact with said fixed contact and a second position to displace said moveable contact away from said fixed contact; a U-shaped spring member having a pair of legs which are engaged with a free end of said moveable contact piece and a part of said actuating member, respectively; said part of said actuating member being guided along the direction of the motion of said free end of said moveable contact piece along a path which is located on the other side of said moveable contact with respect to said free end of said moveable contact piece as seen along the longitudinal direction of said moveable contact piece; said first and second positions of said free end of said moveable contact piece being located inside a range defined by said first and second positions of said part of said actuating member in such a manner that said free end of said moveable contact piece is urged towards its first position by said U-shaped spring member when said part of said actuating member is located at its first position which is located on the other side of said moveable contact piece with respect to said free end of said moveable contact piece as seen along the direction of motion of said moveable contact piece, and said free end of said moveable contact piece is urged towards its second position by said U-shaped spring member when said part of said actuating member is located at its second position which is located on the other side of said moveable contact piece with respect to said free end of said moveable contact piece as seen along the direction of motion of said moveable contact piece.

Thus, the moveable contact piece is positively urged either to contact the moveable contact with the fixed contact or move the moveable contact away from the fixed contact, and this switch-over is carried out in a very quick manner substantially without involving any indeterminate state of contact between the moveable contact and the fixed contact. Further, by providing stoppers for the working part of the actuating member to define the limits to the motion of the latter, any unnecessarily excessive deformation of the U-shaped spring member is avoided and the durability of the spring member is improved even further.

According to a preferred embodiment of the present invention, said part of said actuating member consists of an elastic piece which is cut out from said moveable contact piece and has a common base end. Additionally, said actuating member is provided with a frame member defining an opening through which said moveable contact piece and said elastic piece are passed, mutually opposing surfaces of upper and lower parts of said frame member being provided with projections which act upon said elastic piece. Thereby, the moveable contact piece structure is simplified and made highly compact in size, and the manufacturing cost is reduced.

To minimize the local strains at the two ends of the U-shaped spring members, it is preferred that one end of said U-shaped spring member is received in an opening provided in said free end of said moveable contact piece while the other end of said U-shaped spring member is provided with an opening which receives a free end of said elastic piece.

BRIEF DESCRIPTION OF THE DRAWINGS

Now the present invention is described in the following with reference to the appended drawings, in which.

DESCRIPTION OF THE PREFERRED EMBODIMENT

Figure 1:
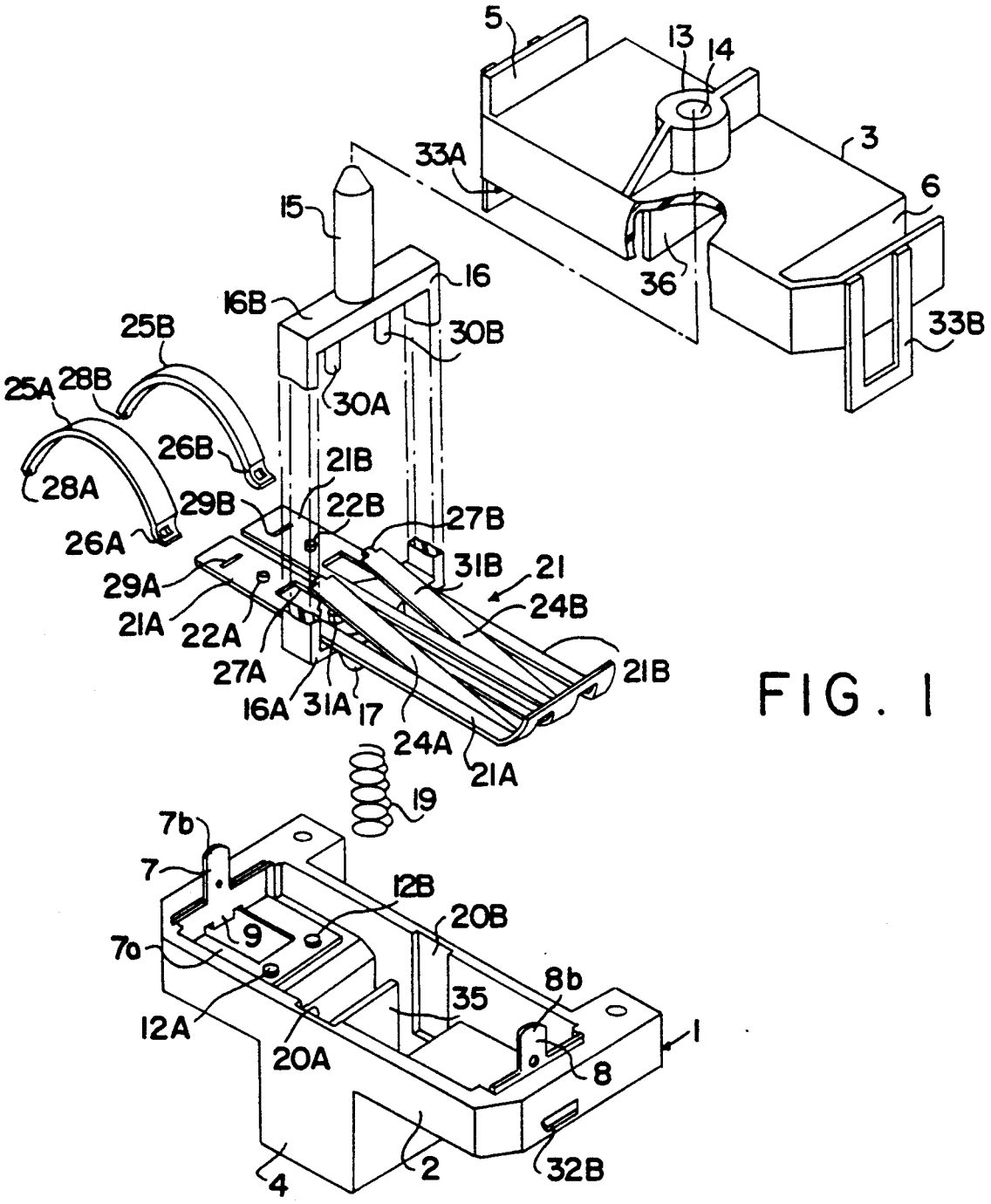
FIG. 1 is an exploded perspective view of a preferred embodiment of the present invention.

As shown in FIG. 1, this electric switch comprises a casing 1 which consists of a lower half 2 and an upper half 3. The lower half 2 is constructed as an elongated shallow box having a deeper middle part 4. The upper half 3 is likewise constructed as an elongated box, and is provided with a pair of lateral slots 5 and 6, at either longitudinal end, for passing lead wires (not shown in the drawings) therethrough. The free ends 7*b* and 8*b* of a pair of terminal pieces 7 and 8 project from the longitudinal end portions of the lower half 2 so as to be passed through holes 10 and 11, respectively, provided in the bottom walls provided in either longitudinal end portion of the upper half 3, respectively, and project into the slots 5 and 6 of the upper half 3, respectively, when the two halves are joined together. One of the terminal pieces 7 is L-shaped, and its base end 7A which is broader than its free end 7B is fixedly attached to the inner bottom wall surface of the lower half 2. The upper surface of the base end 7A of the terminal piece 7 is provided with a pair of laterally spaced fixed contacts 12A and 12B. The base end 8A of the other terminal piece 8 is simply passed through the other longitudinal end of the lower half 2 along the inner surface of the longitudinal end wall thereof.

The central part of the upper wall of the upper half 3 is provided with a boss 13 defining a guide hole 14, through which a rod-shaped push-button member 15 is received. To the lower end of this push-button member 15 is connected a rectangular frame 16. The lateral parts of this frame 16 are received in a pair of guide grooves 20A and 20B, respectively, provided in the lateral inner wall surface of the lower half 2, for guiding the frame 16 along the vertical direction. The central parts of the mutually opposing surfaces of the lower part 16A of the frame 16 and the bottom wall of the lower half 2 are provided with projections 17 and 18, respectively, for securing a compression coil spring 19 which is interposed between the lower part 16A of the frame 16 and the bottom wall of the lower half 2 to bias the frame 16 along with the push-button member 15 upwards.

A moveable contact piece 21 is attached to the base end 8A of the second terminal piece 8 by rivets 23 or the like at its base end in the manner of a cantilever, and is passed through the central opening of the frame 16. The moveable contact piece 21 is bifurcated into a pair of elongated parts 21A and 21B, each of which is provided with an opening 29A or 29B and a moveable contact 22A or 22B at its free end, the opening 29A or 29B being located closer to the extreme end of the elongated part 21A or 21B than the moveable contact 22A or 22B. From each of the two parts 21A and 21B of the moveable contact piece 21 is cut out a cut-out piece 24A or 24B which is connected to the base end of the contact piece 21 at its base end but is otherwise separated from the from the contact piece 21. The free ends of the cut-out pieces 24A and 24B, which extend toward the free end of the moveable contact piece 21 slightly short of the moveable contacts 22A and 22B, are provided with projections 27A and 27B, respectively. The moveable contacts 22A and 22B are positioned so as to cooperate with the fixed contacts 12A and 12B of the base end 7A of the terminal piece 7.

The mutually opposing surfaces of the upper and lower parts 16B and 16A of the frame 16 are each provided with a pair of projections 30A and 30B or 31A and 31B which are adapted to push the cut-out pieces 24A and 24B as described hereinafter.

A pair of U-shaped spring members 25A and 25B are engaged between the free ends of the two parts 21A and 21B of the moveable contact piece 21 and the free ends of the cut-out pieces 24A and 24B, one end of each of the U-shaped spring members 25A and 25B provided with a projection 28A or 28B which is received by the opening 29A or 29B of the corresponding part 21A or 21B of the moveable contact piece 21 and the other end of the U-shaped coil spring member 25A or 25B provided with an opening 26A or 26B for receiving the projection 27A or 27B of the corresponding cut-out piece 24A or 24B.

A pair of stopper pieces 35 and 36 project toward each other from the bottom wall of the lower half 2 and the upper wall of the upper half 3, respectively, for restricting the bending deformation of the cut-out pieces 24A and 24B beyond certain upper and lower limits.

The longitudinal end surfaces of the lower half 2 are provided with projections 32A and 32B which catch the openings provided in the elastic pieces 33A and 33B, respectively, depending from the longitudinal end surfaces of the upper half 3 when the two halves are joined together.

Now the operation of this electric switch is described in the following with reference to FIGS. 2 and 3.

Figure 2:
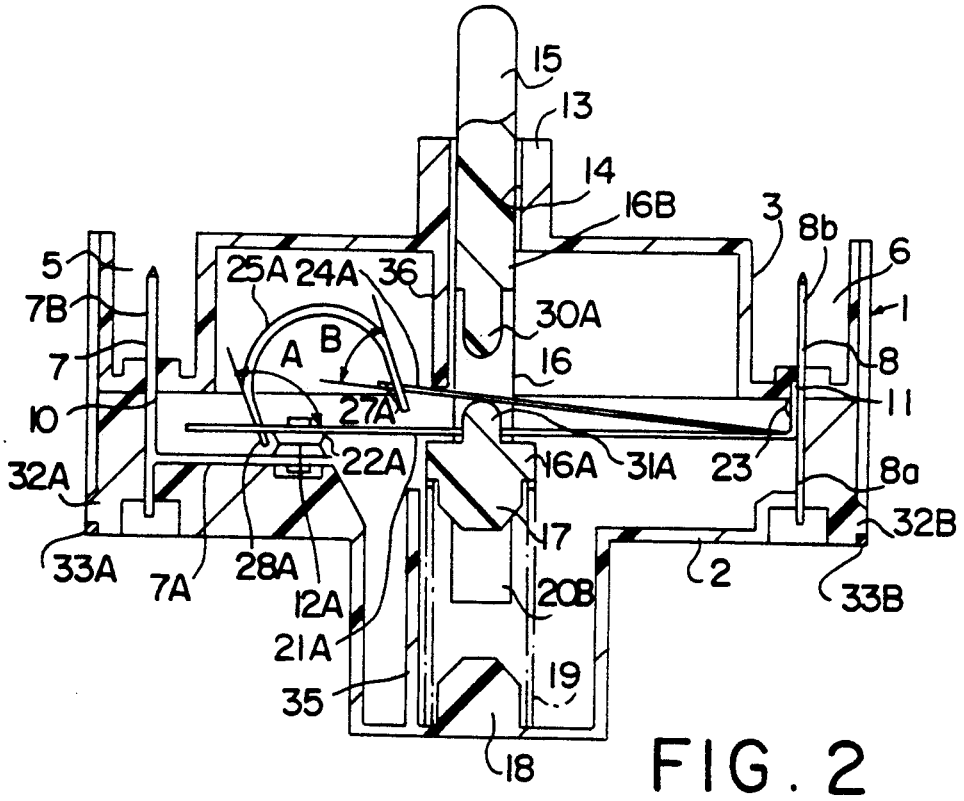
FIG. 2 is a sectional view of the electric switch shown in FIG. 1.
Figure 3:
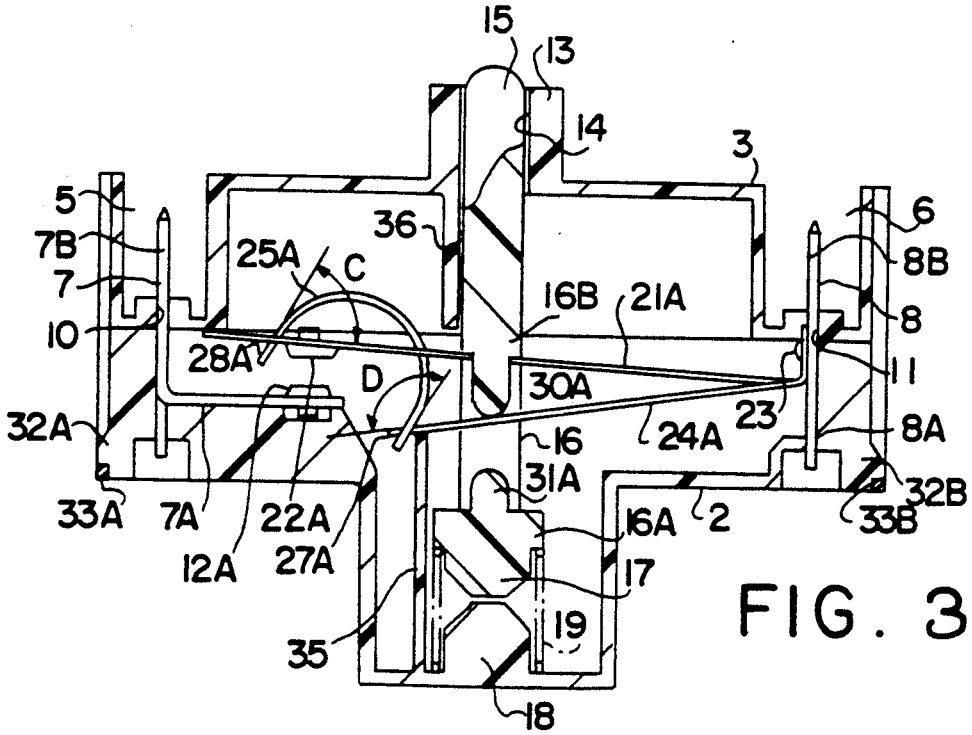
FIG. 3 is a view similar to FIG. 2, showing a different state of the electric switch.

When the push-button member 15 is at its neutral state without being acted upon by a finger or the like, the push-button member 15 along with the frame 16 is located at its upper most position under the spring force of the compression coil spring 19 as shown in FIG. 2. The projections 31A and 31B provided in the lower part 16A of the frame 16 abut the lower surfaces of the cut-out pieces 24A and 24B so as to bend the cut-out pieces 24A and 24B higher than the two parts 21A and 21B of the moveable contact piece 21. This relationship is always produced because the lower end surface of the upper stopper 36 to which the parts of the cut-out pieces 24A and 24B abut to their free ends is substantially flush with the lower surface of the bottom wall of the slot 5, at the first longitudinal end of the upper half 3, to which the free ends of the two parts 21A and 21B of the contact piece 21 in the most upwardly bent state abut, and the contact piece 21 cannot bend upwardly any further. Since the distance L between the two legs of each of the U-shaped spring members 25A and 25B in the assembled state of the switch is always less than the distance between the legs in the natural state of the U-shaped spring members 25A and 25B, the U-shaped spring members 25A and 25B urge the two parts 21A and 21B of the moveable contact piece 21 downwards so as to cause the moveable contacts 22A and 22B to be brought into contact with the fixed contacts 12A and 12B as shown in FIG. 2.

When the push-button member 15 is pressed into the casing 1, the projections 30A and 30B in the upper part 16B of the frame 16 push the cut-out pieces 24A and 24B downwards. The downward deformation of the cut-out pieces 24A and 24B is limited by the lower stopper 35 but the cut-out pieces 24A and 24B can bend lower than the moveable contact piece 21 because the downward bending deformation of the latter is limited by the contact between the moveable contacts 22A and 22B and the fixed contacts 12A and 12B as shown in FIG. 3. As the push-button member 15 is depressed from its upper most position, the spring force of the U-shaped spring members 25A and 25B progressively increases until a critical point is reached where the cut-out pieces 24A and 24B become flush with the moveable contact piece 21. At this moment, the spring force of the U-shaped spring members 25A and 25B which has been urging the moveable contacts 22A and 22B into engagement with the fixed contacts 12A and 12B abruptly changes the direction of its action, and starts urging the contacts 22A and 22B away from the fixed contacts 12A and 12B. As a result, the moveable contact piece 21 is bent upwardly until its bifurcated free end portions abut the lower wall surface of the slot 5 provided at the first longitudinal end of the upper half 3 as shown in FIG. 3. The downward bending deformation of the cut-out pieces 24A and 24B is limited by the lower stopper 35.

When the push-button member 15 is released, the frame 16 is moved upwards into the position illustrated in FIG. 2 under the spring force of the compression coil spring 19. As the cut-out pieces 24A and 24B are bent upwards by being pressed by the projections 31A and 31B provided in the lower part of the frame 16, the cut-out pieces 24A and 24B again pass the critical point where the cut-out pieces 24A and 24B become flush with the moveable contact piece 21. At this moment, the spring force which has been urging the moveable contacts 22A and 22B away from the fixed contacts 12A and 12B abruptly changes the direction of its action, and starts urging the contacts 22A and 22B into contact with the fixed contacts 12A and 12B.

According to this structure, the distance L between the two legs of each of the U-shaped spring members 25A and 25B can be made large since the contacts 12A, 12B, 22A and 22B are located between the two legs of the U-shaped spring members 25A and 25B. Therefore, for a given relative vertical displacement of the two legs of each of the U-shaped spring members 25A and 25B, the bending angles A-C and D-B at their end portions can be reduced, and the strains in the end portions of the U-shaped spring members 25A and 25B can be minimized. This is highly advantageous for ensuring the durability of these U-shaped spring members 25A and 25B.

Additionally, the provision of the upper and lower stoppers 35 and 36 contributes to the prevention of causing excessive strains in the end portions of the U-shaped spring members 25A and 25B through avoidance of causing unnecessarily large bending deformations to the cut-out pieces 24A and 24B and the U-shaped spring members 25A and 25B. The stopper pieces 35 and 36 are also helpful in eliminating the hard feel of the switch when the stopper member 15 is pressed or released all the way, and bottoms out, without requiring any special cushioning members.

Although the present invention has been described in terms of a specific embodiment, various modifications, additions and substitutions can be effected without departing from the spirit of the present invention. For instance, the electric contact structure is by no means limited by the above described embodiment, in which the two moveable contacts 22A and 22B are electrically common to each other, and so are the two fixed contacts 12A and 12B. If desired, the moveable contacts may be electrically separated from each other and/or the fixed contacts may be electrically separated from each other. As a matter of fact, any number of these contact structures may be incorporated in a single electric switch in any desired combinations.

Further, the cut-out pieces 24A and 24B and the moveable contact piece 21 were cut out from a single electroconductive piece, but they may be constructed as separate pieces which are assembled in any desired manner. As for the applications of this electric switch, it can be used as a manual switch which is suitable for actuation by a finger or the like, or, alternatively, as a limit switch which is suitable for actuation by a mechanical member.

What we claim is:

1. An electric switch, comprising:

1) a casing;

2) at least one actuating member pivotally attached to said casing and pivotable between a first and a second position;

3) at least one moveable contact piece pivotally attached to said casing at a base end and pivotable between a third and a fourth position;

4) at least one moveable contact attached to said at least one moveable contact piece;

5) at least one U-shaped spring member, a pair of legs corresponding to each spring member, wherein:

a) one leg of said pair of legs being engaged with a free end of said movable contact piece at an engagement point, and b) an other leg of said pair of legs being engaged with a free end of said actuating member; wherein:

said at least one U-shaped spring urges said at least one moveable contact piece into said third position when said at least one actuating member is in said first position;

said at least one U-shaped spring urges said at least one moveable contact piece into said fourth position when said at least one actuating member is in said second position; and the distance from a base end of said moveable contact piece to said moveable contact is less than the distance from said base end of said moveable contact piece to said engagement point.

2. An electric switch as defined by claim 1, wherein said at least one movable contact piece has at least one longitudinal cut-out portion therein; said at least one actuating member passes through said at least one longitudinal cut-out portion when undergoing transition between said first position and said second position.

3. An electric switch as defined by claim 2, wherein said moveable contact piece and said actuating member are integrally formed.

4. An electric switch as defined in claim 3, wherein said casing is provided with stopper means for defining said first and second positions of said elastic piece.

5. An elastic switch as defined by claim 3, wherein one leg of said U-shaped spring member is received in an opening in said free end of said moveable contact piece and the other leg of said U-shaped spring member is provided with an opening to receive said free end of said actuating member.

6. An electric switch as defined by claim 3, wherein said actuating member is provided with a frame member defining an opening through which said moveable contact piece and said actuating member are passed, said frame member having mutually opposing surfaces being provided with an engaging means for engaging said actuating member.

* * * * *